US007055342B2

(12) United States Patent
Minassian

(10) Patent No.: US 7,055,342 B2
(45) Date of Patent: Jun. 6, 2006

(54) JEWELRY WITH HOUR OF DAY REMINDER MECHANISM

(76) Inventor: Leon Minassian, 460 Henley Ave., New Milford, NJ (US) 07646

( * ) Notice: Subject to any disclaimer, the term of this patent is extended or adjusted under 35 U.S.C. 154(b) by 445 days.

(21) Appl. No.: 10/054,290

(22) Filed: Nov. 13, 2001

(65) Prior Publication Data

US 2003/0089128 A1 May 15, 2003

(51) Int. Cl.
*A44C 5/00* (2006.01)

(52) U.S. Cl. ..... 63/3; 63/1.13; 63/33; 116/284; 116/307; 116/308; 116/309

(58) Field of Classification Search ..... 63/3, 63/4, 1.11, 1.13, 31, 38, 1.12, 9, 10, 28, 29.1, 63/29.2, 30, 40, 33; D11/3, 6, 7, 8; 224/219; 219/222; 116/284, 307, 308, 309, 316
See application file for complete search history.

(56) References Cited

U.S. PATENT DOCUMENTS 1,672,355 A * 6/1928 Ullman ..... 63/1.13
1,734,625 A * 11/1929 Heyman ..... 59/80
1,792,534 A * 2/1931 Germain ..... 63/15
1,832,458 A * 11/1931 Gregory ..... 116/316
2,322,461 A * 6/1943 Mariano ..... 63/3
2,427,257 A * 9/1947 Campbell ..... 63/20
2,510,224 A * 6/1950 Hettinger ..... 40/633
3,217,514 A * 11/1965 Newman ..... 63/31
3,374,949 A * 3/1968 Hayden ..... 235/123
3,992,901 A * 11/1976 Parente ..... 63/37
4,077,237 A * 3/1978 Loper ..... 63/31
4,130,987 A * 12/1978 Schickedanz ..... 368/29
4,179,833 A * 12/1979 Knodel ..... 40/633
4,184,344 A * 1/1980 Pepin ..... 63/31
4,393,667 A * 7/1983 Reinstein et al. ..... 63/29.1
4,400,932 A * 8/1983 Epstein ..... 59/82
4,912,307 A * 3/1990 Shade et al. ..... 235/123
4,977,757 A * 12/1990 Mesica et al. ..... 63/15
5,110,130 A * 5/1992 Aulicino ..... 273/153 S
5,787,731 A * 8/1998 Ebara ..... 63/29.1
5,896,757 A * 4/1999 Kharloubian ..... 63/31
6,065,971 A * 5/2000 Lennon ..... 434/246
6,196,025 B1 * 3/2001 Moshkovitz ..... 63/23
6,216,490 B1 * 4/2001 Radley-Smith ..... 63/3
6,223,559 B1 * 5/2001 Coleman ..... 63/1.13
6,260,383 B1 * 7/2001 Warren et al. ..... 63/15
6,467,307 B1 * 10/2002 Watson ..... 63/3
6,532,766 B1 * 3/2003 Chia et al. ..... 63/26
6,561,415 B1 * 5/2003 Grant ..... 235/61 R

* cited by examiner

*Primary Examiner*—Jack W. Lavinder
(74) *Attorney, Agent, or Firm*—Levisohn, Berger & Langsam LLP

(57) ABSTRACT

An article of jewelry, such as a bracelet, contains twelve or twenty-four primary links, each having a visual representation that identifies an hour of the day. Each link is provided with a reminder mechanism, preferably a group of stones. One of the stones is selected for viewing in association with the primary link for the hour of the day that an act or event is desirably remembered. The selected stone is color-coded to represent an activity to be remembered, such as a meeting, a child pick-up, or telephone call or the priority associated with the event, e.g., urgent, important, can be rescheduled, etc. Since the selected stone of the reminder mechanism is associated with a given hour of the day, by correlating the selected stone to the primary link of the hour of the day of the event or act to be remembered, the wearer is reminded of the hour of an event sought to be remembered.

12 Claims, 4 Drawing Sheets

FIG. 1
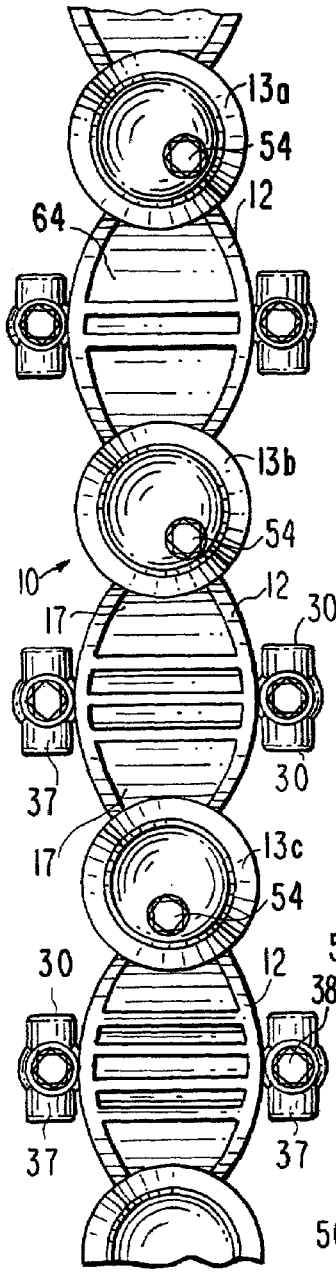
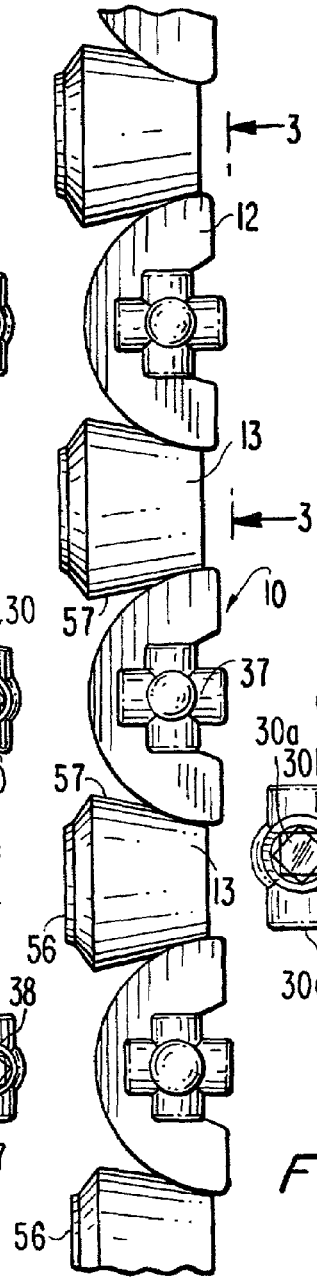
FIG. 2
FIG. 3
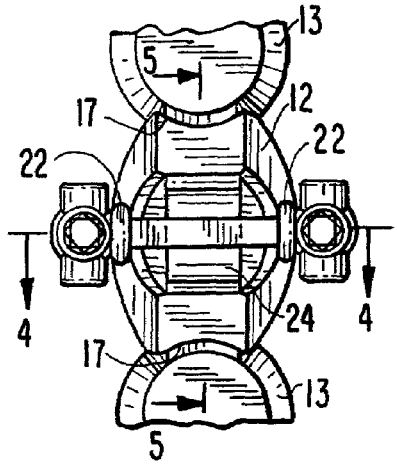
FIG. 4
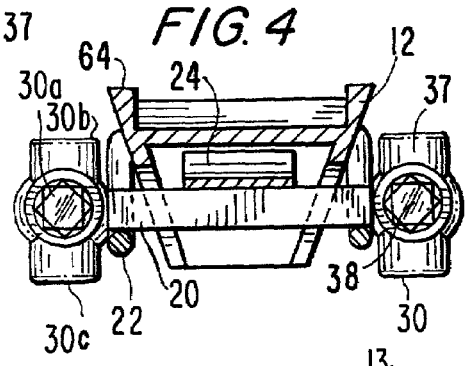
FIG. 5
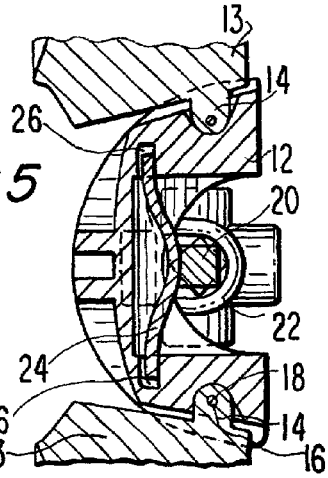

JEWELRY WITH HOUR OF DAY REMINDER MECHANISM

FIELD OF THE INVENTION

The present invention relates to an article of jewelry with an hour of the day reminder mechanism. More specifically, the present invention relates to an article of jewelry, such as a bracelet, which includes twelve or twenty-four separate hour-indicating links, each carrying a rotating crown-like device having multicolored beads, stones or gem stones (hereinafter often referred to as "stones") that can be turned so that the color of the bead of a particular link or links will serve as a visual reminder to the wearer and remind the wearer of the hour of the day when an event or act is to occur.

BACKGROUND OF THE INVENTION

As can be seen by reference to U.S. Pat. Nos., 6,167,726; 6,223,559; 3,217,514; 3,968,661; 4,077,237; 6,186,552; 6,000,159; and 6,164,815; and European Patent 0513 540 A1, the prior art includes identification bracelets and jewelry that have the capability of an item thereon being adjustable to provide one of multiple views or representations. In this manner, the representations could provide a visual clue or reminder to the wearer that an event is to occur or to be remembered during the day. However, the prior art does not seem to teach an article of jewelry which can be manipulated so that a specific time of day i.e., the hour, is provided.

For example, U.S. Pat. No. 3,217,514 (the '514 patent) discloses a jewelry article, such as a bracelet formed from a plurality of links. Each link has an opening in which an ornament having multiple faces is pivotable. The ornament has a gem or stone mounted on one of its obverse faces. The ornamental member may be pivoted on bearings to swing either of its obverse faces into selective view. However, the '514 patent does not teach coordinating the links to hours of the day nor does it teach the rotation of an ornament so as to cause a visual signal to be displayed to facilitate remembering a specific act or time to do something during the day.

U.S. Pat. No. 4,077,237 (the '237 patent) discloses a jewelry item, such as a charm or pendant, where the wearer may change markings appearing through an opening. One such marking can be selected for display through a central opening so that coded messages can be exchanged between the wearer and an observer. This is meant to enhance the "dating" ritual. The indexed markings may be numerals or colors that are located on a wheel. The wheel can be selectively moved to a defined position for prominent display of a particular index marking through the window. The individual representations, such as the numerals or colors, are not individually rotatable in the '237 patent nor is there any teaching nor suggestion of using the indexed marking(s) as a mechanism for providing the wearer with a time of day reminder to do a certain event or act. The pendant has no mechanism for coordinating a reminder with an hour of the day to do the act or event.

There exists a need for the provision of an article of jewelry with a specific hour of the day or time reminder mechanism that allows for the selective rotation of an otherwise visually attractive bead, stone or gem stone to a particular position that serves to remind the wearer of the jewelry of the time that a particular event or act should take place or is scheduled. People with demanding daily business or recreational schedules are in need of a wearable and attractive piece of jewelry that will also serve the purpose of an appointment keeper or reminder, such as for appointments, press conferences, staff meetings, telephone calls, dinner times, or other events or acts to be done or attended.

SUMMARY OF THE INVENTION

It is an object of the present invention to provide an attractive article of jewelry, primarily comprised of links, preferably 12 or 24 such links, corresponding to the hours of the day, to form a bracelet, with a time reminder, i.e., hour of the day, mechanism that allows the rotation of a bead or stone on a selected one or more links to a particular position that serves to remind the wearer of the jewelry of a specific hour for an event or an act to occur.

It is another object of the present invention to allow an individual to rotate the bead or gem or stone of the link(s) to select one of a plurality of color-coded stones or beads on an item of jewelry to remind the individual of the relative importance or type of event or action to be taken at a particular time. So, for example, rotating the crown of a link so that it displays a red bead (or a ruby face) on the link numbered III (or 3) may provide a visual reminder to the wearer of an important event, e.g., taking a medication at 3 p.m. If, in addition or in lieu of that selection, a yellow bead is rotated on the IV (4) link, then the wearer may be reminded of a less serious event, possibly, making a phone call at 4 p.m. to see if one's car is ready from the repair shop. The colors can be selected by a pre-understood order of importance, red, for example, being the highest level of importance, white, for example, being relatively unimportant, or the colors can be understood to represent a particular type of event, e.g., red meaning a required business meeting or conference with another; yellow meaning "Call My Mother Just to Say, 'Hello,'" etc. The versatility of the present invention should be apparent to those of skill in the art, after reading the specification.

It is a further object of the present invention to provide for twelve or twenty-four links that may hooked or held together to form an article of jewelry, preferably a bracelet. Each link is correlated, in some visually discernable manner to an hour of the day. In the preferred embodiment of the present invention, 24 links are provided with each link bearing a Roman numeral, Arabic number or even an analog watch face with a stone marking, to visually indicate that that link is associated with one hour of the 24 hour day. Of course, other embodiments can be made so that, for example, a bracelet with 9 links can be provided, labeled 9 a.m. to 5 p.m. (in some visually attractive manner) for a working person's bracelet. Each hour of the day link is provided with a reminder member, preferably a rotatable crown or wheel, which can be rotated relative to the link to selectively display a colored stone or bead to remind the wearer of the jewelry of a precise time for an event or action to be taken at a particular hour of the day.

Further objects and/or advantages of the invention will become apparent in conjunction with the disclosure herein.

To accomplish the above objects, the present invention, in one preferred embodiment provides an item of jewelry, such as a bracelet, having twenty-four links representing the twenty four hours of the day with each link marked consecutively with a Roman Numeral from I through XXIV. Alternatively, the links may be marked with Arabic numerals, of course. Alternatively, the bracelet may have twelve (or even nine for the working hours) links with numeric markers. A diamond, precious stone, other stone or bead can be rotated into view on the appropriate link corresponding to an hour to mark a certain act or event to occur. The stone or bead may be held in a setting, knob or crown which can be rotated with respect to the link so that it may display through an opening one or more colors so that a reminder of the hour of the day is provided as well as an importance indicator associated with the event to be remembered. The stones are connected in a rotatable crown, rosette, box or other grouping, preferably of three or four to eight stones. In this manner, an article of jewelry is provided which to the non-wearing observer is merely an attractive article of jewelry with colorful stones and, yet, to the wearer is both attractive and quite functional, as a time of day and relative importance event or act reminder and indicator.

In one embodiment of the invention, an axle is provided which extends vertically through the center's of the hour of the day links. The ends of each of the axles are provided with boxes bearing on each side a single of four differently colored stones. In this manner the axle may be rotated to place into view the one color or stone on the hour of the day link to distinguish that link from the others. Different colored stones or beads can be used to indicate different levels of priorities or different event types. For instance, red can be used for high priority, green for low priority, blue for a business appointment, white for a personal appointment or black for recreational appointments. The user selects the stone to be put into the visual orientation of the link and turns the axle for the proper hour of the day link until the stone appears upwardly, i.e., is in view. By rotating the axle, a stone, like rotating the crown of a watch, the box rotates and the proper side of the box with the right colored stone is placed into viewable position. In one embodiment of the invention, the selected stone gently clicks into place by a mechanical detent so one stone or bead faces upwardly in the viewing position for the proper hour of the day link of the bracelet and it will remain there until manual movement changes the reminder mechanism. This selected stone is associated with an hour of the day link, as visually provided to the wearer by a numeral, Roman or Arabic, or an analog representation of a watch with a stone marker for the hour of the day for an event or act to be remembered.

Although the principal purpose of the invention is to serve as a reminder of the hour of the day for something to be done or happen, the jewelry may be worn just as a piece of jewelry and the stones, alternatively, may be adjusted to match the color of an outfit or the taste of the wearer. For example, a red dress can be complemented simply by revealing the red stones of the links of the bracelet or a navy blue suit can be worn with all stones of the hour of the day links turned to reveal the diamond faces of the reminder mechanism. The visual flexibility of the box or crown, with multiple colored stones thereon, secured to an axle which is rotatable, lends to different usages, but the primary purpose of the article is as jewelry and as a reminder of the hour of the day to do an event or act. In addition to each crown being provided with stones on four faces of the box-like crown (four is preferred and located 90 degrees from one another) the crown can be finished with enamel coloring or with gold (real or not) with the words "on" and "off" engraved or written on the faces of the rotatable crown. Or, the crown can be replaced with a pushbutton-like on/off mechanism. Here, the hour of the day link is either "on" or "off" to denote whether an act or event will or will not occur at the time of the day indicated by the link.

The appointment keeper, basically comprising a set of links with visual indications for the hours of the day and having a visual reminder/indicating mechanism which can be selectively activated or deactivated functions as an article of jewelry and, in addition, as a functional reminder to the wearer of the time that an act or event is meant to occur or take place. The basic concept of this invention may be applied to other items of jewelry, as well, such as rings, earrings and pendants.

BRIEF DESCRIPTION OF THE DRAWINGS

An understanding of the invention can be gained from the following description of the preferred embodiments when read in conjunction with the accompanying drawings in which:

FIG. 1 is a top plan view of a portion of a bracelet, comprised of several links (three full primary links are shown with three full connecting links) where the primary links are provided with a visual indicator (in this case Roman numerals) to associate each primary link with an hour of the day and further where each primary link is provided with a rotatable axle having a crown, with four stones (on both ends) one stone on each face of the box-like crown to provide a visual mechanism to remind the wearer of an event or act which is to occur at the particular time provided by the visual indicator on the primary link. The connecting links reinforce the hour of the day visual indication. Here the connecting links are an analog watch face with a stone marker or indicator of the hour of the day. The connecting links are located to the left of the corresponding primary links. This is one of the preferred embodiments of the present invention.

FIG. 2 is a side view of the portion of the bracelet shown in FIG. 1.

FIG. 3 is a rear view of a portion of the bracelet, taken along lines 3—3 of FIG. 2, showing the rear of a full primary link and the mechanical manner of operation of the reminder mechanism.

FIG. 4 is a cross-sectional view taken along the lines 4—4 of FIG. 3 of a portion of the bracelet with reminder mechanism, in accordance with an embodiment of the present invention.

FIG. 5 is a cross-sectional view taken along the lines 5—5 of FIG. 3;

DETAILED DESCRIPTION OF THE PREFERRED EMBODIMENTS AND THE DRAWINGS

Figure 6:
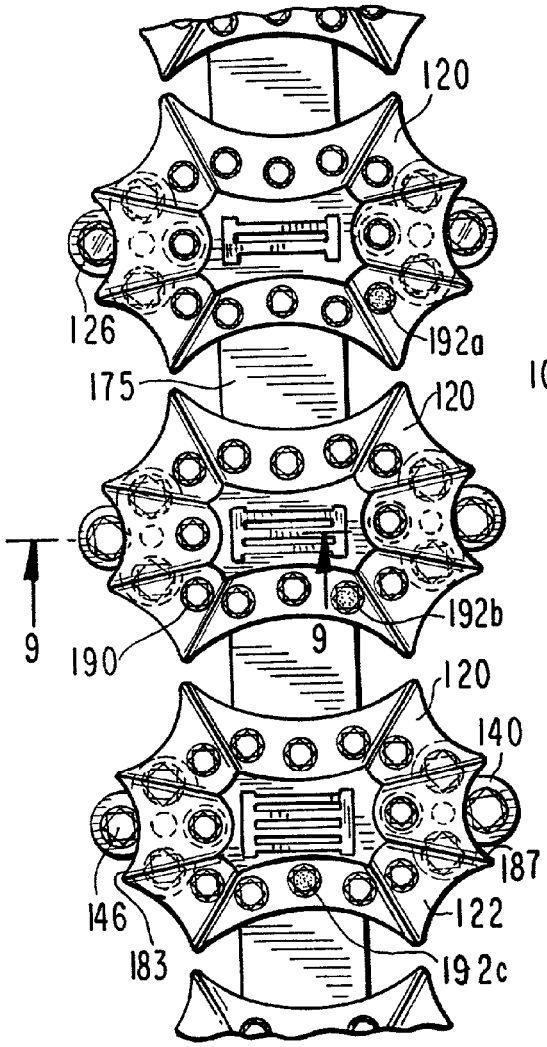
FIG. 6 is a top plan view of several primary links of a different or second embodiment of the present invention where the links are identified by Roman numerals and, in addition, by analog watch faces with a marking stone. A rotatable wheel with four stones is used for indicating the occurrence of an act or event for the primary links.
Figure 7:
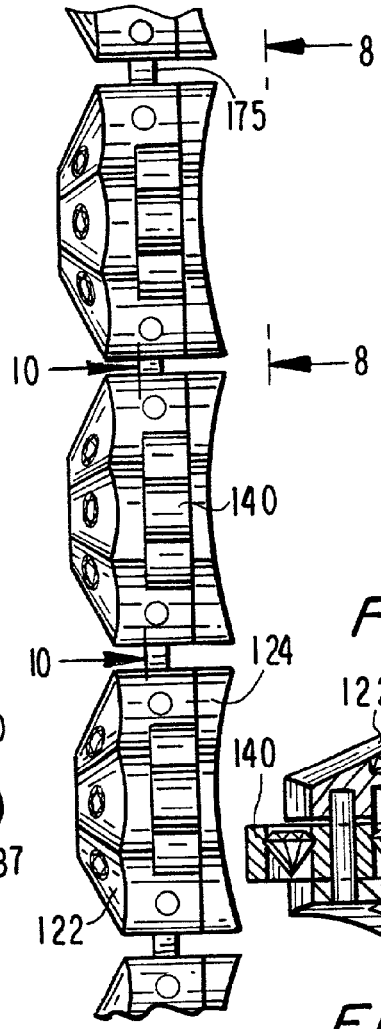
FIG. 7 is a side view of the embodiment of the invention shown in FIG. 6.
Figure 9:
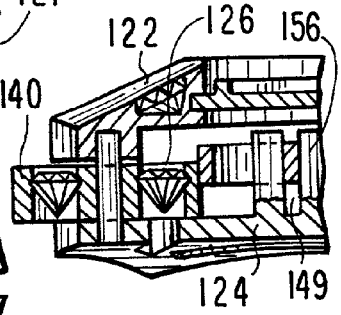
FIG. 9 is a cross-sectional view taken along the lines 9—9 of FIG. 6.

As shown in FIG. 1, an article of jewelry 10 with an event or act indicator and reminder mechanism is shown. The present invention is illustrated and described in accordance with a preferred embodiment. In this embodiment, bracelet 10 comprises primary links 12, there being twelve such linkages in the preferred embodiment although 24 links can be used or even 8 (for the hours of the working day). Each primary link is somehow visually identified to correspond to and be associated with an hour of the day (or night) for which the wearer might need to be reminded of an act or event to do or to take place. In the preferred embodiment, the primary links 12 are provided with successive Roman numerals I through Roman numeral XII (not shown). As best seen in FIG. 1, primary links 12 show Roman numerals I, II, and III. The portion of the bracelet shown in FIG. 1 only shows primary links I, II, and III. Connecting adjacent primary links 12 is a connecting link or element 13. The connecting links 13 are, in this the preferred embodiment, also provided with a visual representation of the hour of the day for the event or act to be reminder of. Here, the connecting links 13 display the analog face of a watch and a single stone or marker to designate the hour of the day of the primary link to which the connecting link is associated or located, by being on its left. So, for example, as seen in FIG. 1, connecting link 13*a*, to the left of and adjacent to primary link 12 (with Roman numeral I) is shown with a stone 54 located at 1:00 on the analog face, while connecting link 13*b*, adjacent to and to the left of primary link 12 (with Roman numeral II) shows the stone 54 located in relative analog watch face position at 2:00. Connecting link 13*c*, then, to the left of and next to primary link 12 (with Roman numeral III) shows the stone 54 in the 3:00 position on the representation of the analog watch face. Thus, in this embodiment there is a connecting link 13 having a visual representation (in this case an analog watch face with stone identifier 54) as a second manner of indicating to the wearer the hours of the day for use in the reminder mechanism of the bracelet 10. Each primary link 12 and connecting link 13 are, in the preferred embodiment, formed from 14, 18 or 24 kt. gold, platinum, from silver or any other durable material. The specific shapes and designs are ornamental and can be left to the artisan and wearer. Each primary link, however, is provided with a visual indicator of the hour of the day for which a reminder may be needed for an act or event. Each connecting link need not have a visual indicator of the hour of the day but, in the preferred embodiment, the connecting links 13 are provided with a back-up visual indicator of the time of day for potential use with the reminder mechanism.

The primary and connecting links 12 and 13 are connected together to form a complete bracelet, with a suitable clasp (not shown) also provided. Of course, it should be appreciated that the bracelet 10 can be formed from only primary links or even from only connecting links (but, here, the visual indicator of the hour of the day for the connecting links would be required). That, of course, is the design decision of the manufacturer and the wearer. What is essential, however, is providing a complete article of jewelry, preferably a bracelet, formed of several links with at least one link identified and associated with each hour of the time period for which an event or act may need to be remembered. As mentioned, not every hour of the day need be provided for the bracelet to be functional. So, for example, if only reminders of events or actions are necessitated for the hours between 6:00 p.m. and 12 a.m. (6 total hours) by a night watchman, then only 6 links are required. The bracelet then is formed from relatively large links or additional non-hour (or connecting) links are used to form the complete bracelet.

Figure 11:
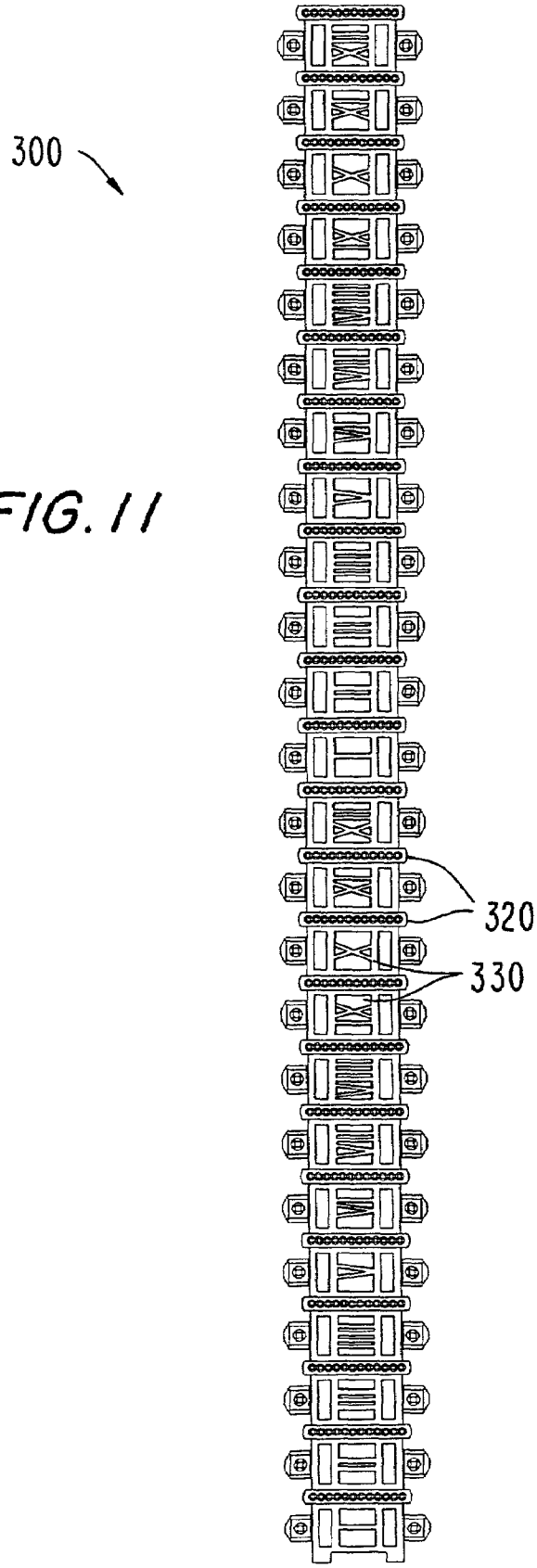
FIG. 11 is a top plan view of another embodiment of the present invention, showing the primary links provided with Roman numerals and, in addition, by the relative vertical location of a marking gem along the right side of the primary links. Here, the reminder mechanism is basically the same as that shown in relation to the bracelet and links of FIGS. 1–5, i.e., a rotatable set of boxes with four faces (with colored stones) located on the two ends of a rotatable axle.
Figure 11A:
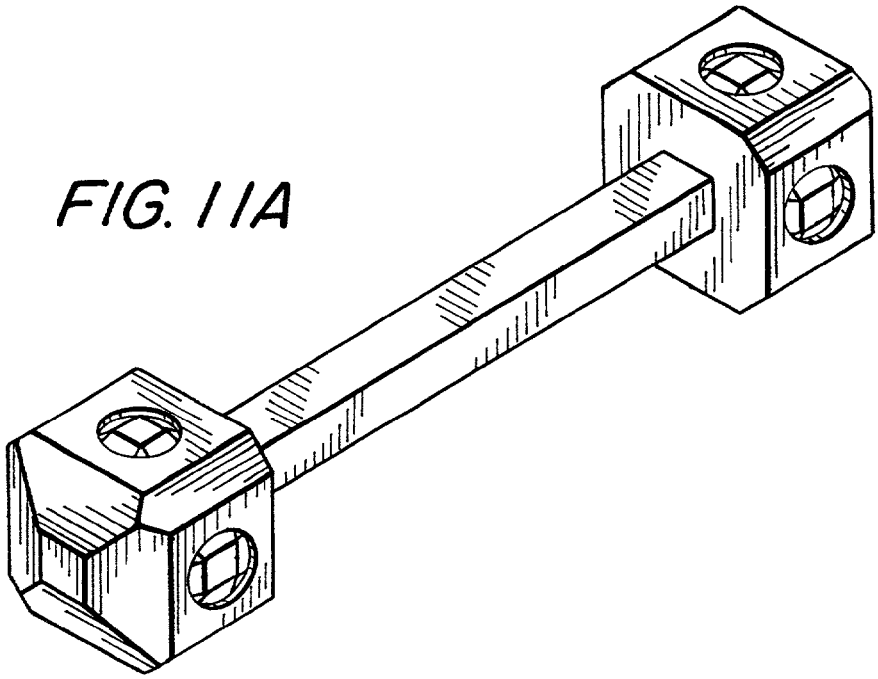
FIG. 11A is a perspective view of the reminder mechanism, removed from a primary link, as would be used with the embodiments of FIGS. 1–5 and FIG. 11, comprised of an axle, a pair of opposed four-sided boxes with the faces of the boxes having a different colored stone. The axle, in the preferred embodiment, is a square cross-sectional unit so that it can be rotated and locked into place by cooperation with a leaf spring until physically moved to display a different face and stone color of the box.

Each primary or connecting link 12 and 13, respectively, is visually associated with an hour of the day by the use of a set of visual identifiers, e.g., a set of Roman numerals can be embossed or otherwise made on the surfaces of the primary links. Alternatively, instead of identifying the links with Roman numerals, they may be identified with Arabic numerals or the analog representation of a watch face with a stone may be used. Further, as shown in the embodiment of FIG. 11, the connecting links can use a vertical row of gems (preferred diamonds) with the marking stone (a ruby, sapphire or emerald) substituted in the row of diamonds at the location of the row to identify the connecting link's hour of the day.

Each primary link 12 (of the embodiment shown in FIG. 1) comprises a generally oval yet side-truncated or concave, top surface 64. The concavity is meant to accommodate the circular side surface of the connecting links 13. The primary links 12 and connecting links 13 are hingedly connected together to form a bracelet with some measure of flexibility so that it can be comfortably worn. In the embodiment shown in FIGS. 1–5, the primary links 12 and connecting links 13 are hingedly connected by the use of ears 14 located on the connecting links, having apertures 18 passing therethrough, with an aligned bore 15 (not shown) of the primary links 12, located at the outside ends 17 of the primary links. A hinge pin 16 passes through the apertures 18 of the ears 14 of the connecting links 13 and through the bore 15 of the primary links 12. Then, of course, the hinge pin 16 is bent, the ends enlarged or otherwise closed-off so that it can not be easily removed. This provides mechanical linkage of the primary and connecting links 12 and 13, respectively, and, yet, allows the pieces to easily rotate with respect to one another for flexibility of the bracelet and comfort. For ease of illustration the hinge pins, apertures and bores are not shown in FIG. 3. Of course, any conventional manner of linking and allowing flexibility between primary links and/or connecting links can be used.

As seen in FIG. 2, connecting links 13 have a tapered, truncated cylindrical shape, relatively flat on the top and bottom surfaces. Each connecting link 13 has a flat top 56 and a circular and downwardly tapered side surface 57. The flat top 56 may have a stone 54 positioned thereon to identify the connecting link 13 and correspond the same to an hour of the day, as correlated to position of an analog clock face.

As discussed, the connecting links 13 are located to the left of the corresponding primary link ( which in this embodiment is identified by Roman numerals).

As shown in FIG. 3, a rear view of a portion of the bracelet of FIG. 1 (a portion of two connecting links 13 and one primary link 12) reveals that each primary link 12 comprises two C-shaped, concave sides or outside ends 17 which allow the circular and downwardly tapered side wall 57 of the connecting links 13 to nest therein. An axle 20 extends transversely across the width of the primary links 12 and across the longitudinal extension of the bracelet. The axle 20 is held by a pair of opposed loops 22 secured to the bottom of the primary links and extending basically perpendicularly therefrom. The axle 20 is held by the loops 22 and yet is able to be rotated therein but a spring leaf (discussed hereinafter) provides a mechanism for limiting the amount of free rotation of the axle. More specifically, the spring leaf 24 in cooperation with the square cross-sectional configuration of the axle 20 allows the axle to be rotated but provides 4 separate stopping positions for the axle, i.e., when one of the flat surfaces of the axle is flush against the top surface of the spring leaf, a positional stop is provided. This ensures proper alignment between one of the stones on the faces of the knob 37 or crown of the axle and the top surface of the primary links 12.

The ends of the spring leaf 24 extend into two small, edge cavities 26 in the bottom surface of the primary links 12. The spring leaf 24 extends in the direction across the primary link, i.e., in the longitudinal direction of the bracelet, from outside end 17 to outside end 17 of the same primary link. The center of the spring leaf 24 is a bump and projects away from the top of the primary link and is in contact with the axle 20. The resiliency of the spring leaf 24 allows rotation of the axle 20 but allows the axle to "click" into location and alignment when a flat surface of the axle (in the preferred embodiment it has four flat surfaces as it is a square in cross-section) is against the center portion or projecting bump of the leaf spring. When the axle 20 is rotated, the spring leaf 24 is compressed and the edges of the spring leaf slide further into the edge cavities 26 which are designed and machined to be deep enough to accommodate that action and movement. Then, further rotation of the axle 24 causes the spring leaf to flex back (due to its resiliency) until a flat surface of the axle 20 lies upon or against the center or bump of the spring leaf and the spring leaf, being biased away from the top of the primary link, holds the axle 20 from further rotation. Stated another way, the cooperation of the spring leaf 24 and the axle 20 allows the axle to be rotated by hand and, yet, the cessation of hand rotation by the wearer will result in the positive holding of the axle 20 in relative position as a consequence of the bias of the spring leaf against the axle. Each spring leaf 24 of each primary link 12 functions to impede the rotation of the axle 20 lying on its surface, such that the axle may be manually rotated but after rotation by hand, the axle will be fixed in a selected position.

The ends of the axle 20 are provided with a crown or knob 37. Preferably the crown is provided with four sides 30 (in a cross-like manner), each side having a colored stone or gem 38. In the preferred embodiment, one stone could be a diamond (bezel set) 30*a*; another stone—an emerald 30*b*; another stone could be a ruby 30*c* and the fourth stone could be a sapphire 30*d* (not shown). Each is bezel-set or otherwise held in the sides of the crown or knob 37. A crown or knob 37 is fixed (by screw threads or welding) to the two ends of the axle 20 such that rotation of one of the knobs causes the axle 20 to rotate which flexes the leaf spring and causes the other knob or crown 37 on the other end of the same axle to correspondingly rotate. Alternatively, the knobs can rotate independently of one another, although connected to the same axle. Preferably, however, the sides 30 of the knobs on each end of the axle display the same stone such that when one side, 30*c*, for example, is rotated to be viewed the corresponding side 30*c* of the other knob of the axle is also viewable, i.e., directed upwardly. Of course, the sides of the two knobs can be different, too, so that, in theory, 8 different colors (or numbers) can be provided to the sides 30 of the two knobs 37 for a single axle 20, to provide the user with an even greater ability to remember and prioritize his acts and events over the course of a day. One set of the sides 30 of a knob 37 can be used to indicate the type of event to be remembered and the other knob and set of sides for the same axle can be used to prioritize the importance of the act or event, e.g., red or the ruby signifying the highest priority—white or the diamond indicative of the lowest priority. The opposed knob 37 on the same axle 20 can have stones or markings representing certain types of events or acts, e.g., black or onyx could be indicative of a court appearance; "AM" could be engraved on the side of the knob to reflect that the hour for the primary link is in the morning, not night; or white may be used to signify a meeting, etc.

The spring leaf's bias in a direction away from the top of the primary link causes one of the flat sides of the axle to be held in place. Rotation of the knob and axle is the manner of allowing the wearer to change the reminder device (the colored, marked or numbered sides of the knob) for the particular selected primary link from one reminder type or color to another.

Each axle 20 has the shape of a rectangular solid such that a cross-section of each axle is square-shaped. Each link 12 has two loops 22, each located on opposing sides of the bottom of the links 12. Each axle 20 is long enough to extend through the two opposing loops 22 on its respective primary link 12. The loops 22 capture the axle and yet allow rotation, within the constricts of the spring leaf.

The color of the stone for the reminder mechanism (the axle and knob(s) in the embodiment of FIGS. 1–5) may represent an activity or event. For example, clear may represent a meeting, blue may represent a telephone call, red may represent a medication and yellow may represent a purchase to be made.

The bracelet 10 is equipped with a conventional closing or clasp mechanism (not shown) to allow the bracelet to be secured to and easily removed from the wearer's wrist.

In use, the bracelet may have the stones of the knobs all visible with the same color directed in the same direction. This would be the starting position of the bracelet and could be worn by the user merely as an article of attractive jewelry. The color of the stone pointing upwardly, i.e., viewable by an observer and the wearer could complement the clothing being worn. However, when an event or act is recognized as necessary to be remembered or looked into at a certain time of day, a knob 37, secured to an axle 20, for the primary link 12 corresponding to the hour for the act or event will be rotated by clockwise or counterclockwise movement. Rotation of that one knob occurs until the selected distinct color or side of the knob is directed upwardly and is visible. Alternatively, of course, the other knobs can be rotated so that they change from the original color. The event, act, or priority of the event or act, depending on the color selected for that primary link will be associated with the hour of the time of the day of the primary link 12. Other reminders may be provided as well, for the other primary links, if desired. Thus, an article of jewelry is presented which is attractive, functional and serves as a time of day reminder for acts or events. The wearer only needs to look at the wrist with the bracelet and review the primary links with the knobs and their stones rotated into different viewable positions to know when and what type of events are to be remembered. In this manner, the wearer will remember the act or event or priority of the act or event and the time i.e., hour of the day that it is intended to happen or occur.

In the embodiment of the invention shown in FIG. 11, a bracelet 300 comprises primary links 330 alternating with connecting links 320. The connecting links 320 visually extend vertically, i.e., they are only about a stone or gem in thickness. The primary links 330 and connecting links 320 are provided in sufficient numbers and hingedly connected to form a flexible bracelet 300. A connecting clasp of conventional configuration is also provided (not shown). In this embodiment, the connecting links 320 comprise twelve vertically stacked stone positions (primarily for pave, bezel or prong-set diamonds). However, each connecting link 320 to the right of each primary link 330 (the latter with Roman numerals thereon to provide the visual indication of the hour of the day for an event or act to be remembered) has a colored stone (a ruby, sapphire or emerald) corresponding in vertical location in the vertically-oriented 12 stone positions for the hour of the day of the corresponding primary link 330. So, for example, the first connecting link to the right of the first primary link with Roman numeral I thereon, has the top-most stone a ruby, with the next 11 vertically- stacked stones, all diamonds. The next connecting link 320 to the right of the primary link 330 with Roman numeral II thereon has its top-most stone a diamond, then a ruby (in the #2 position), and then 10 vertically-stacked diamonds thereunder. The last connecting link 320, to the right of the last primary link 330 marked XII (or XXIV) will have 11 vertically-stacked diamonds and the lower-most stone a ruby. In this manner, each primary link 330 is provided with an associated connecting link 320 which ensures that the wearer knows the hour of the day that each primary link 330 corresponds to. The primary links 330, as in the embodiment shown in FIGS. 1–5, have an axle, a spring leaf, a pair of knobs for each axle and colored stones on the faces of the knobs, to enable the wearer to select one or more stones for viewing by rotating the knobs until display of a desired side of the knob is achieved so that a reminder is provided for the selected hour of the day, i.e., for that primary link 330 and associated link 320.

Figure 8:
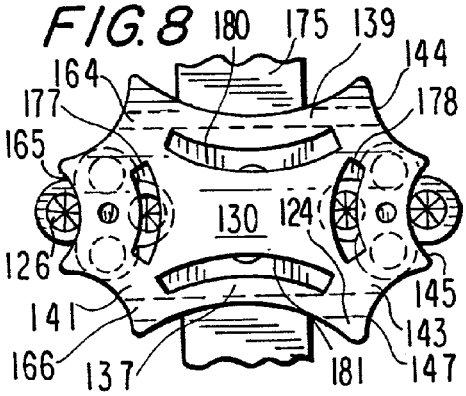
FIG. 8 is a bottom view taken along the lines 8—8 of FIG. 7, showing the rear of a primary link and the mechanical manner of operation of the reminder mechanism.
Figure 10:
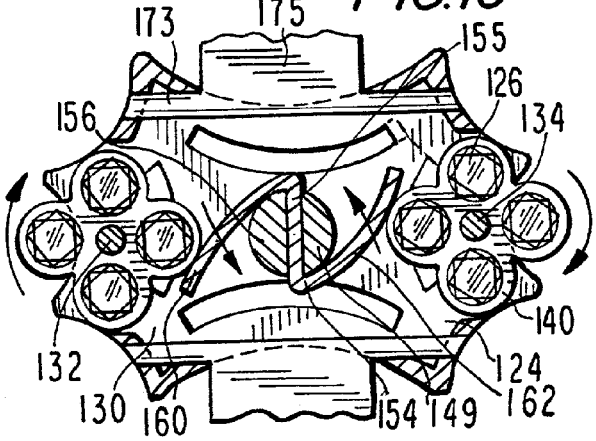
FIG. 10 is a cross-sectional view taken along the lines 10—10 of FIG. 7, showing the top view of the bottom housing of the primary link and the mechanical manner of operation of the reminder mechanism.

In another embodiment of the invention, as shown in FIGS. 6–10, primary links 120 comprise a top housing portion 122 and a bottom housing portion 124. The links 120 are formed in two portions so as to enable them to be cast of precious metal and to facilitate assembly of the internal components. Final assembly contemplates that these pieces are secured together by soldering around their common edges. As shown in FIGS. 8 and 10, the bottom housing portion 124 is formed with a relatively flat base 130; a centrally located and upwardly projecting cylinder 156 having a central slot 149; and a pair of opposed pins 132 and 134, also projecting upwardly (see FIG. 10). A rosette 140 comprised of four bezel-set different colored stones or gems 126 (diamond, ruby, sapphire and emerald, for example) is rotatably secured on each of the pins 132 and 134. The slot 149 of cylinder 156 is the mechanism for holding the bight 155 of Z-shaped metal band 154. The metal band is made of resilient material and the two legs of the Z-shaped metal band, 160 and 162 extend away from the cylinder and curve toward the innermost of the stones of the rosette 140. The rosette 140 can be selectively turned (about pins 132 or 134) to display one of the stones or gems 126 to the viewer while the other three stones or gems 126 of the rosette 140 are hidden by the upper housing portion (See FIG. 6). The contact of a leg 160 and 162 of the Z-shaped metal band or spring 154 against the circumferential edge of the rosette where the innermost stone or gem 126 is located acts as a detente, locking the reminder mechanism (the colored stones of the rosette) in location unless the rosette is further manually rotated. However, the resiliency of the Z-shaped metal band 154 allows easy manual rotation of the rosette to change the stone or gem for display.

The flat base 130 is symmetrical about both an imaginary horizontal line and an imaginary vertical line through its center. The flat base 130 forms a first long side 137 and a second long side 139 along its length and a first shorter side 141 and a second shorter side 143 along its width. The first long side 137 and the second long side 139 each are inwardly curved or concave extending towards each other. The first shorter side 141, like its opposed mate, second shorter side 143, has three contiguous, inwardly curved wall segments 164, 165 and 166 and 144, 145, and 147, respectively. The first shorter side 141 and the second shorter side 143 are mirror images of each other. The flat bases 130 are secured, preferably by soldering, to connecting links or a common underlying band 175. As can be seen in FIG. 10, the primary links 120 of this embodiment can be hingedly secured to the connecting links by a pin, 173, perpendicularly secured to the connecting links and rotatably securing the primary links by being rotatably secured in holes in the short curved wall segments 164, 144 and in short curved wall segments 147 and 166.

As shown in FIG. 8, the flat base 130 is provided with a set of opposed, short curved apertures 177 and 178, and a pair of opposed, long curved apertures 180 and 181. These apertures are primarily to conserve precious metal material during manufacture.

It should be appreciated that the outside perimeter of the upper housing portion 122 conforms to that of the lower housing portion 124. This, then, allows the selected stone 146 of the rosette 140 to be viewable through the window defined by the concave surface provided by the short and opposed curved upper walls 183 and 187, superimposed over the center curved wall segments 165 and 145 of the first and second shorter sides 141 and 143 of the lower housing portion 124. Of course, the short curved upper walls 183 and 187 and the center curved wall segments 145 and 165 are short in height to accommodate the thickness of the rotatable rosette and stones.

The top housing portion 122 is situated over the bottom housing portion 124 such that one stone 146 on each rosette 140 is visible when a stone is rotated into the viewing window (defined by the short curved upper walls). In the construction of the primary links 120, the top housing portion 122 may be soldered into position after the rosettes 140 and Z-shaped metal band 154, as explained above, are situated.

The top housing 122 is provided with a set of stones 190; encircling in an analog-like watch face the perimeter of the primary link. All stones of the set of stones 190 are the same color with the exception of a single stone for each primary link. A single differently colored stone 192 (*a*, *b*, and *c*) for each primary link 120 is secured at the relative position corresponding to the hour of the day for the primary link 120. So, as can be seen in FIG. 6, colored stone 192*a* is located at the 1:00 position for the primary link 120 identified with Roman numeral I, while colored stone 192*b* is located at the 2:00 position for the primary link 120 identified with Roman numeral II, and the colored stone 192*c* is located at the 3:00 position for the primary link 120 identified with Roman numeral III. Thus, two visual mechanisms are provided for visually identifying the bracelet's primary links so that the wearer knows the hour of the day that each link corresponds to. Clearly, however, the Roman numerals may be eliminated and only the analog watch face provided on the top housing portion 122 and colored, marking stones 192 used by the manufacturer or, alternatively, the Roman numerals alone can be used. As shown in the embodiment, however, both Roman numerals and the analog watch face and hour markers (stones 192) can be used together.

In use the wearer determines, when he or she first learns of an act or event to be remembered, which of the primary links 120 corresponds to the hour of the day for remembering the act or event. Then, the rosette 140 of that primary link 120 is rotated to select the colored stone for viewing and reminding. This is accomplished by rotation of the rosette until the desired colored stone is moved into the viewing window, defined by the upper housing's short curved wall, 183 and 187. If only a single event is to be remembered, the other stones are kept as a single color so as to distinguish the selected rosette of the primary link and its stone therefrom. Either both rosettes of the same primary link can be rotated to display the same color or one rosette can be used to identify the function to be remembered (e.g., red means lunch date, blue means telephone call, green means pick up daughter or son, or the second rosette can be used to display the importance of the event, e.g., red means no deviation allowed in time; blue means 10 minute deviation permissable; white means the act or event to be remembered can be easily rescheduled to another date, if necessary, etc.

In yet another embodiment constructed similarly to the primary links 122, a primary link (not shown), necessarily provided with at least one visual mechanism for indicating the hour of the day for an event, is equipped with a selectively retractable button to "open" and "close" a shutter for a window. The user may selectively push the button to retract the shutter to expose a stone through the window for viewing. Then, the primary link with the stone showing through the window will serve as a reminder for an act or event for the corresponding hour of the day for that primary link.

Figure 12:
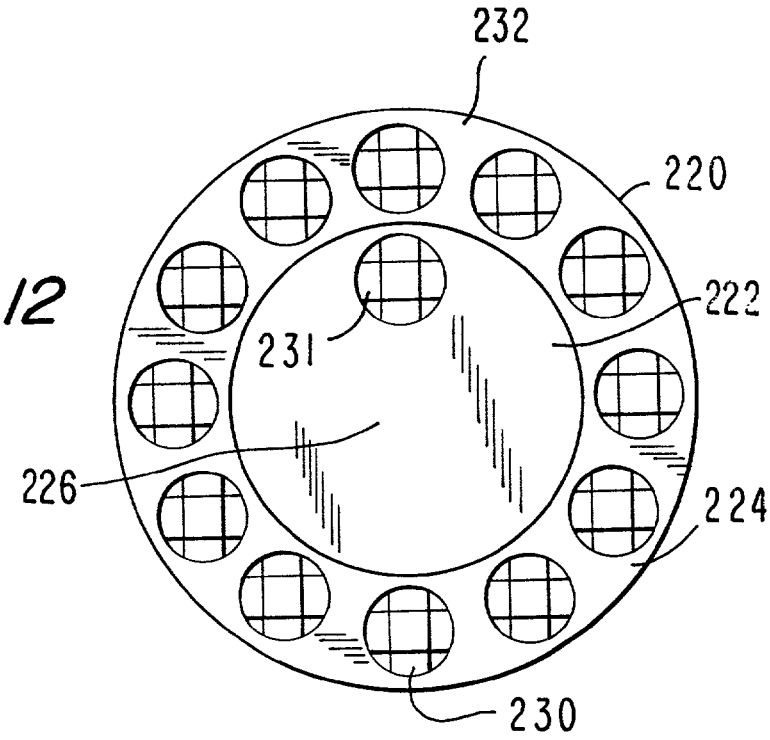
FIG. 12 is a top plan view of another version of a primary link which could be used with the present invention, here, however, the link is an analog version of a watch face. The outer ring, with 12 stones, can be rotated with respect to the inner marker or reminder mechanism. This single link can be formed into a jewelry ring. It would allow a wearer to recall an event or act based on the relative rotation and visual appearance provided by the outer "racetrack" with respect to the marker or reminder mechanism supplied by the inner relative circular portion.

In yet another embodiment of the invention, as shown in FIG. 12, a primary link 220 comprises an inner round portion 222 and an outer and surrounding ring or annulus portion 224. The inner portion 222 has a colored stone 231 located at its outer periphery. The surrounding ring portion 224 is provided with a set of 12 stones about its perimeter to resemble an analog watch face. The outer round portion may be provided with a single marking stone to indicate the 12:00 position of the analog watch face provided by the set of 12 stones. The outer portion 224 is connected to the inner portion 222 so that the inner round portion and its reminder/indicating stone may rotate within the fixed surrounding ring portion 224. The twelve stones 230 represent the hour of the day for remembering an act or event. When the colored stone 231 of the inner round portion 222 is rotated into alignment with the stone on the surrounding ring portion 224 for which an act or event is to remembered the device serves as a jewelry reminder. This primary link 220 can be a component of a pendant, a ring, a pin or other article of jewelry. It, too, can be a primary link in a bracelet.

In accordance with yet another embodiment of the present invention, a primary link in the preferred shape of a rectangle or round, analog clock face is provided with a marking stone at the 12:00 position. This allows the wearer to determine and know th location of the other hours of the day, much like the Movado® Museum Watch. Extending radially outward from the center of the analog watch face, one for each hour of the 12 hour watch face, is a groove. The center of the face is further provided with a ring groove, extending near but slightly radially around the center of the face. The ring groove originally holds at least one, preferable several mounted gems, with their prong settings or other holding means, extending below (and thus not viewable) the ring groove. The wearer can selectively slide one of the gems by physically moving the gem by contact with its table, from the ring groove to the radial groove corresponding to the hour of the day for the event to be remembered. If more than one gem is provided in the ring groove then more than one event of the 12 hour day can be remembered. The gems of the ring groove are radially slid to the radially extending hour of the day grooves to serve as a reminder to the wearer of the time of day, i.e., the hour for the event. In an alternate embodiment, in lieu of a ring groove extending around the center of the watch face for holding the gems before placement into the selected hour radial groove, the gems can be held in the 12:00 radial groove and then slid into the radial groove of the hour(s) of the event to be remembered. After the event is recalled, the gems are slid back to their original positions, in the ring groove or the 12:00 radial groove, depending on the embodiment.

In accordance with the present invention, different visual or tactile indicia may be used to indicate the hour of the day on a set of primary links. For example, twenty-four primary links may be used with each link having a visual or tactile representation of the hour of the day. As disclosed, the representations can be Roman numerals, Arabic numerals, an analog watch face, a column of 12 stones, braille numerals, etc. A reminder mechanism, in the preferred form a precious stone, is used to visually identify the primary link of interest for the reminder event or act. The stones (in color or numbering thereon) can be representative of the event to be remembered or the priority of the event or act to be remembered. Selectively, the reminder mechanism is manipulated (for example, by rotating a knob) until the stone of choice is revealed on the primary link corresponding to the hour of the day for the reminder. This then provides an attractive article of jewelry to be worn and a reminder mechanism for the hour of the day to perform an act or event.

Having described this invention with regard to specific embodiments, it is to be understood that the description is not meant as a limitation since further variations or modifications may be apparent or may suggest themselves to those skilled in the art. It is intended that the present application cover such variations and modifications.

I claim:

1. An article of jewelry for remembering the starting hour for one or more events in the course of a day, comprising:

a set of primary links which are provided with a set of sequential, hour of the day indicators, a visually unique indicator for each link for visually indicating the hour of the day associated with said primary link, a set of connecting links, said connecting links being spaced between said primary links and together with said primary links forming a bracelet, at least one of either said set of said primary links and said set of connecting links being provided with at least one rotatable knob having two or more visually different marker faces, said marker faces being turnable by said knob while said bracelet is worn by a wearer so that a selected and different face is viewable to the wearer of said article of jewelry in association with said link to indicate to the wearer which one or more of said primary link for the associated hour of the day corresponds to said one or more starting hours for each of said events to be remembered wherein said set of hour of the day indicators are Roman numerals and said set of connecting links are also provided with a second set of hour of the day indicators in the visually readable format corresponding to an analog watch face.

2. An article of jewelry as claimed in claim 1 wherein said at least one rotatable knob comprises four faces, each face having a different colored stone thereon from the other stones on said knob.

3. An article of jewelry as claimed in claim 1 wherein each of said at least one rotatable knob has four faces, each of which is provided with a colored gem.

4. An article of jewelry as claimed in claim 1 further comprising a biasing mechanism comprising an axle of square cross-section for said rotatable knob and a resilient spring bearing against a flat surface of said axle for ensuring that said at least one rotatable knob is maintained in place until manually moved into a new orientation.

5. An article of jewelry as claimed in claim 1 wherein said primary links are made from precious metal.

6. An article of jewelry as claimed in claim 1 wherein said article is costume jewelry.

7. A bracelet for remembering the starting hours for one or more events in the course of the day, comprising:

a series of primary links connected to form a bracelet, each primary link comprising a visually readable format corresponding to an analog watch face design, the series of primary links having a set of sequential, hour of the day indicators, a visually unique indicator for each primary link for visually indicating a sequential portion or all of the hours of the day, when all of said links are viewed;

and each primary link being further provided with at least one rotatable rosette having two or more visually different colored stones, such that only one selected stone, at any one time is primarily viewable by the wearer to indicate to the wearer which one or more primary links bearing an hour of the day indicator corresponds to the one or more events to be remembered and further wherein said indicators for said primary links are provided with Roman numerals to indicate the starting hour for which said one or more events may occur in a day.

8. A bracelet as claimed in claim 7 wherein said rotatable rosette has four distinct colored stones to indicate to the wearer two or more levels of importance or types of events to be remembered.

9. A bracelet as claimed in claim 7 wherein each of said rosettes are held in place by a resilient spring leaf.

10. A bracelet as claimed in claim 7 wherein said analog watch face design and said indicators are comprised of diamonds and different colored stones.

11. A bracelet as claimed in claim 7 wherein said primary links are made from precious metal.

12. A bracelet as claimed in claim 7 wherein said bracelet is costume jewelry.

* * * * *